US008760065B2

(12) United States Patent
Chan et al.

(10) Patent No.: US 8,760,065 B2
(45) Date of Patent: Jun. 24, 2014

(54) PASSIVE ANTI-ARCING PROTECTION DEVICE FOR FLUORESCENT LAMP BALLAST

(75) Inventors: Cho Sing Chan, Hong Kong (CN); Ming Tai Ho, Hong Kong (CN)

(73) Assignee: Century Concept Limited, Hong Kong (CN)

( * ) Notice: Subject to any disclaimer, the term of this patent is extended or adjusted under 35 U.S.C. 154(b) by 380 days.

(21) Appl. No.: 13/184,585

(22) Filed: Jul. 18, 2011

(65) Prior Publication Data

US 2012/0161657 A1 Jun. 28, 2012

Related U.S. Application Data

(60) Provisional application No. 61/425,770, filed on Dec. 22, 2010.

(51) Int. Cl.
*H05B 41/14* (2006.01)

(52) U.S. Cl.
USPC .... 315/207; 315/241 R; 315/245; 315/209 R; 315/119

(58) Field of Classification Search
CPC ..... H05B 41/2851; H05B 41/2858; H05B 41/285
USPC ..... 315/207, 241 R, 245, 209 R, 291, 276, 315/312, 246, 51, 52, 58, 119
See application file for complete search history.

(56) References Cited

U.S. PATENT DOCUMENTS

| | | | | |
|---|---|---|---|---|
| 4,350,935 | A * | 9/1982 | Spira et al. | 315/291 |
| 7,211,966 | B2 * | 5/2007 | Green et al. | 315/224 |
| 7,507,001 | B2 * | 3/2009 | Kit | 362/276 |
| 8,299,727 | B1 * | 10/2012 | Xiong et al. | 315/299 |
| 8,310,160 | B1 * | 11/2012 | Xiong et al. | 315/120 |

* cited by examiner

*Primary Examiner* — Haiss Philogene
(74) *Attorney, Agent, or Firm* — Muncy, Geissler, Olds and Lowe, P.C.

(57) ABSTRACT

A passive anti-arcing protection components for electronic ballasts of fluorescent lamps. This protection component is a bridge-rectifier-resistor-capacitor network, containing at least a diode, a resistor, and a capacitor. The component's circuitry is electrically connected to the ballast at the lamp side, acting as a low-resistance redirection path for any sudden change in energy. When an arcing condition is about to occur, this protection circuitry absorbs the spark energy, ceasing the arcing condition.

14 Claims, 8 Drawing Sheets

PASSIVE ANTI-ARCING PROTECTION DEVICE FOR FLUORESCENT LAMP BALLAST

CROSS-REFERENCE TO RELATED APPLICATION

This application claims benefit from U.S. provisional application No. 61/425,770, filed Dec. 22, 2010, the content of which is incorporated herein by reference.

FIELD OF THE INVENTION

This invention relates to an anti-arcing protection device for ballasts driving fluorescent lamps. More particularly, it relates to a passive anti-arcing protection device for instant-start type electronic ballasts.

BACKGROUND OF THE INVENTION

Fluorescent lamp is a very popular way of lighting. It has the advantages of high efficacy, long service life and does not emit much heat through radiation. The lamp, however, has to be started by introducing a high ignition voltage across it. There are many starting scheme for fluorescent lamps by using an electronic ballast. One popular type of electronic ballast is the instant-start ballasts.

The instant-start type ballast features almost immediate start of the lamps when the AC power is applied to the ballast. It does not require a starter device or circuit. It consumes less energy during operation and thus it is more efficient. However, as the lamp is started with a brute force by building a very high ignition voltage to the lamp, frequent on-and-off switching of the lamp will decrease the useful service life.

Therefore instant-start type ballasts are the most useful in applications where very long time of continuous lighting is anticipated. With many other advantages such as simple installation and the capability of independent lamp operation, i.e., when one of the lamps is worn out or removed, the remaining lamps can still operate normally, the instant-start type ballast enhances safety and the ease of maintenance.

For an instant-start type ballast, it is not uncommon to see an ignition voltage going as high as 600V-1000V peak and more. In cases such as individual lamp removal during maintenance while the AC power is still applied to the ballast, or the lampholder being aged, sporadic open circuit in the lampholder may occur. As a result, a high voltage will be induced and cause arcing. Arcing is a very high energy path of plasma discharge when electrical breakdown of air occurs under a very high potential difference. Arcing inside the lampholders is not favorable, as the resultant high temperature can melt the plastic housing and cause the exposure of metallic contacts and even cause a fire. Moreover it will degrade the contacts and over-stress the components inside the ballasts.

Therefore, recently global product safety certification agencies such as the Underwriters Laboratories (UL) have introduced a class of "Type CC" (short for Commercial Cabinets) ballasts that are designed to minimize arcing within the lampholder. Since then many lighting ballast manufacturers start to design "Type CC" ballasts with anti-arcing protection, or non-arcing fluorescent lamp holders. The usual approach is to sense abnormal voltage and/or current inside the ballast circuit to detect the occurrence of arcing, and cease the ballast operation once the condition is confirmed. They usually involve active devices and even micro-controllers. Thus, a more cost-effective and miniature solution is needed so that the additional components can fit into the existing casings.

SUMMARY OF THE INVENTION

Accordingly, one object of the present invention is to provide a cost-effective and less bulky anti-arcing component for fluorescent lamp electronic ballasts. This anti-arcing protection component is a low-resistance redirection path for any sudden changes in energy and is connected to the load of a fluorescent lamp as a potential bypass which springs into action when an arcing condition is about to occur by absorbing the spark energy and thereby ceasing the arcing condition. A preferred implementation of the protection component of the present invention is by using a bridge-rectifier-resistor-capacitor network, containing at least a bridge-rectifier, a resistor, and a capacitor. However, other equivalent implementations known to people of ordinary skill in the art are also workable as long as a low resistance bypassing is provided parallel to the load. The choice of capacitance and resistance can be predetermined by a person of ordinary skill in the art, which represents a tradeoff between the steady-state power loss of the resistors and the anti-arcing effect. As a guideline, larger capacitance and lower resistance values will result in higher loss, but will give better anti-arcing performance. Thus, the specific choices of resistors and capacitors are not part of the present invention. Rather, they are within ordinary skill of the art in light of the principles of the present invention.

Another object of the present invention is to provide an anti-arcing protection device which can fit into casings of existing electronic ballasts. The protection components according to the present invention can afford a miniature design for an internal addition for making existing ballasts safe, thus eliminating the need to change the existing fixtures.

The various features of novelty which characterize the invention are pointed out with particularity in the claims annexed to and forming a part of this disclosure. For a better understanding of the invention, its operating advantages, and specific objects attained by its use, reference should be made to the drawings and the following description in which there are illustrated and described preferred embodiments of the invention.

DETAILED DESCRIPTION OF PARTICULAR EMBODIMENTS OF THE INVENTION

The present invention is now described below in detail with reference to the figures.

Figure 1:
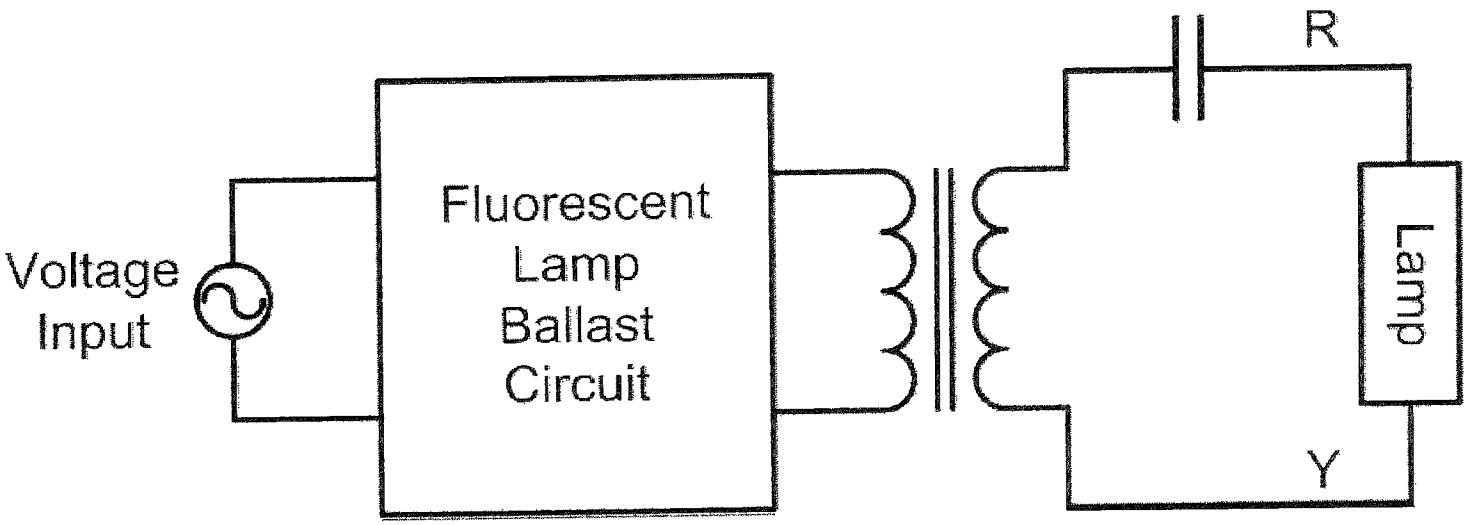
FIG. 1 (Prior Art)
FIG. 1 depicts a general structure of an instant-start type electronic ballast driving one lamp (prior art).

Turning to FIG. 1, it represents a general structure of an instant-start type electronic ballast driving one lamp. Voltage is applied to the fluorescent lamp ballast circuit as shown in the left side in the drawing. The fluorescent lamp ballast circuit builds a high voltage across points "R" and "Y" (shown in the right side) in order to start the lamp and, after starting, maintains sufficient power to sustain normal lamp operation. Arcing may occur at points "R" and "Y" if the connection is intermittent in the lampholders, causing problems.

Figure 2:
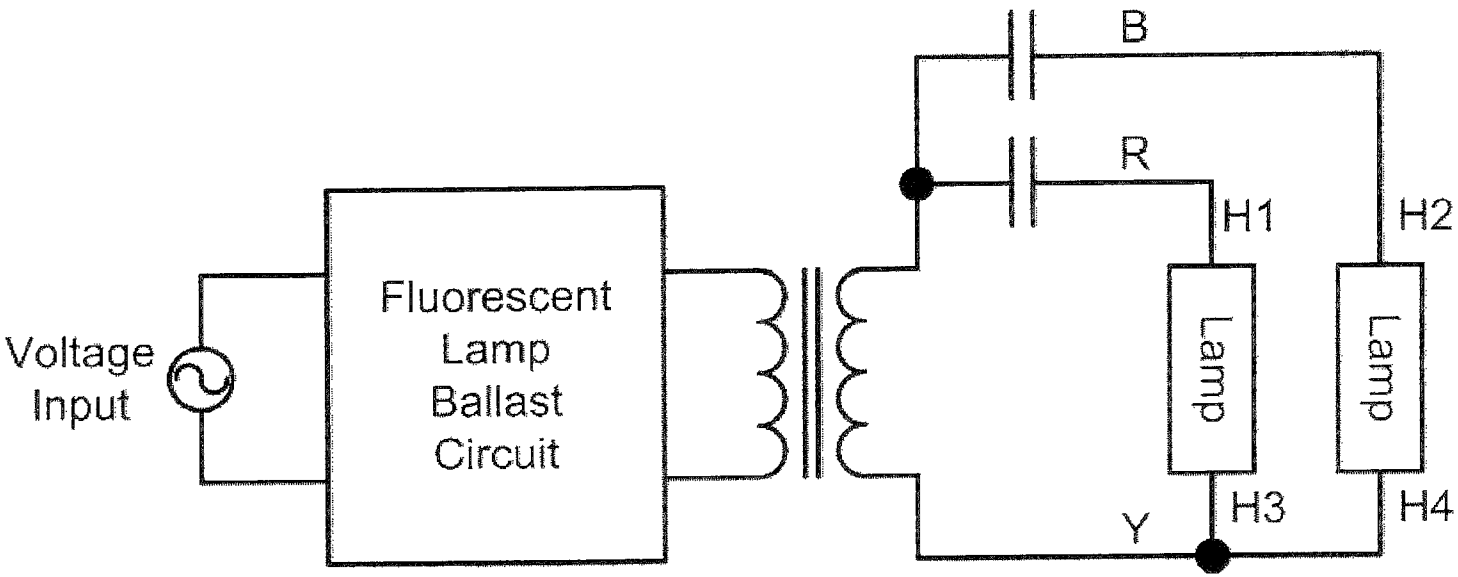
FIG. 2 (Prior Art)
FIG. 2 depicts a general structure of an instant-start type electronic ballast driving two lamps (prior art).

Similar problems exist in the general structure of an instant-start type electronic ballast shown in FIG. 2, which drives two lamps. The process of starting the lamps is similar, that is, by introducing high voltages across points "B"-"Y" and "R"-"Y", respectively. As the electronic circuit is continuously running, energy has to be maintained at all times. Thus, when an individual lamp is suddenly disconnected for whatever reasons, a high potential will be built up across the disconnection points "H1" and "H2" or "H3" and "H4", respectively, causing a high induced electric field. Such high electric field is a condition for arcing to occur.

Figure 3:
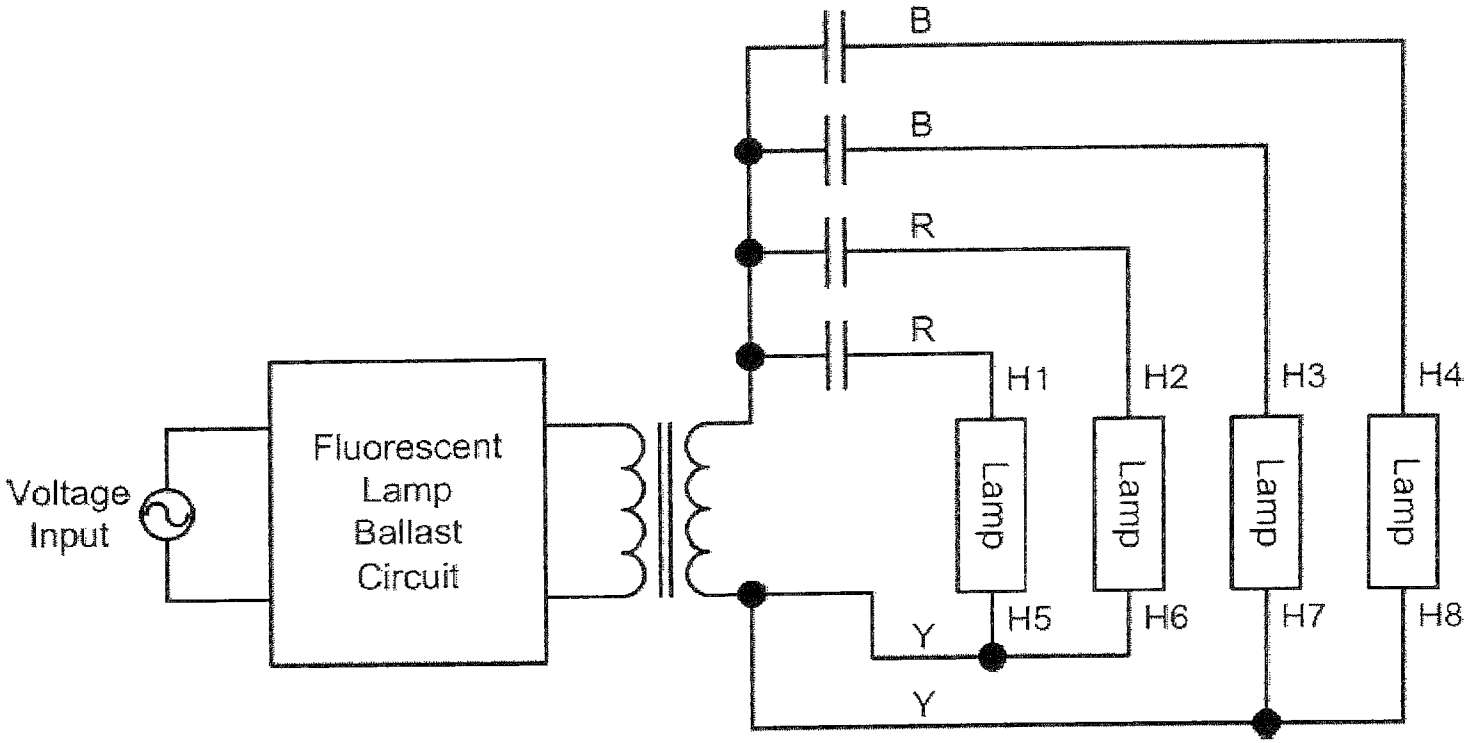
FIG. 3 (Prior Art)
FIG. 3 depicts a general structure of an instant-start type electronic ballast driving four lamps (prior art).

Similar arcing condition may also be present in the general structure of an instant-start type electronic ballast that drives four lamps as shown in FIG. 3. High voltages are built to start the lamps, and arcing may occur at points "H1", "H2", "H3", "H4", "H5", "H6", "H7" or "H8" when an individual lamp is suddenly disconnected for whatever reasons.

Figure 4:
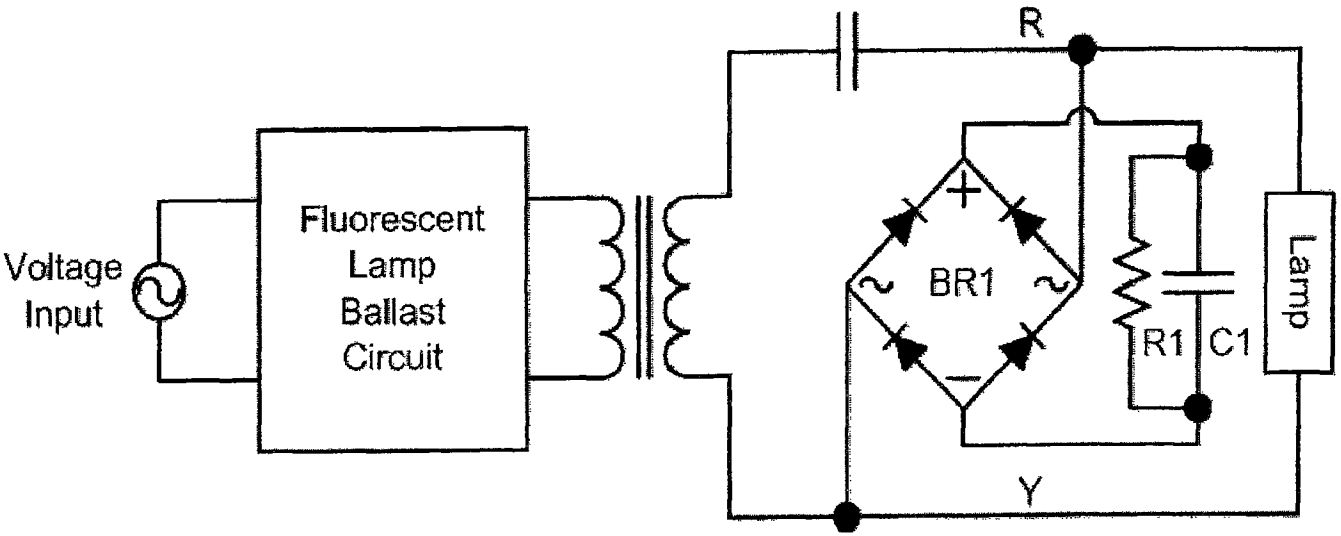
FIG. 4 is a schematic representation of a particular embodiment of the present invention using a passive anti-arcing component in an instant-start type electronic ballast driving one lamp.

To prevent or minimize the dangerous arcing conditions as discussed above, the present invention develops a novel structure of an electronic ballasts. FIG. 4 shows one of such novel electronic ballasts in a single-lamp configuration. In this particular embodiment, a circuit component comprising a bridge rectifier "BR1", a resistor "R1" and a capacitor "C1" is added at the output of the ballasts, effectively across the lamp. This additional circuit acts as a low-resistance redirection path for any sudden change in energy. When the electronic ballast is in normal operation, it consumes only a slight amount of power. However, when the lamp is about to be disconnected from the lampholders while the AC power is still applied, the original energy that will likely cause a spark or even an arc will be redirected, through the diodes in the bridge rectifier "BR1", into the "R1"-"C1" network. Thus the potential difference between the disconnection points will not rise to a value so high that favors a high enough electric field. As a result, the potential arcing can be safely eliminated.

Figure 5:
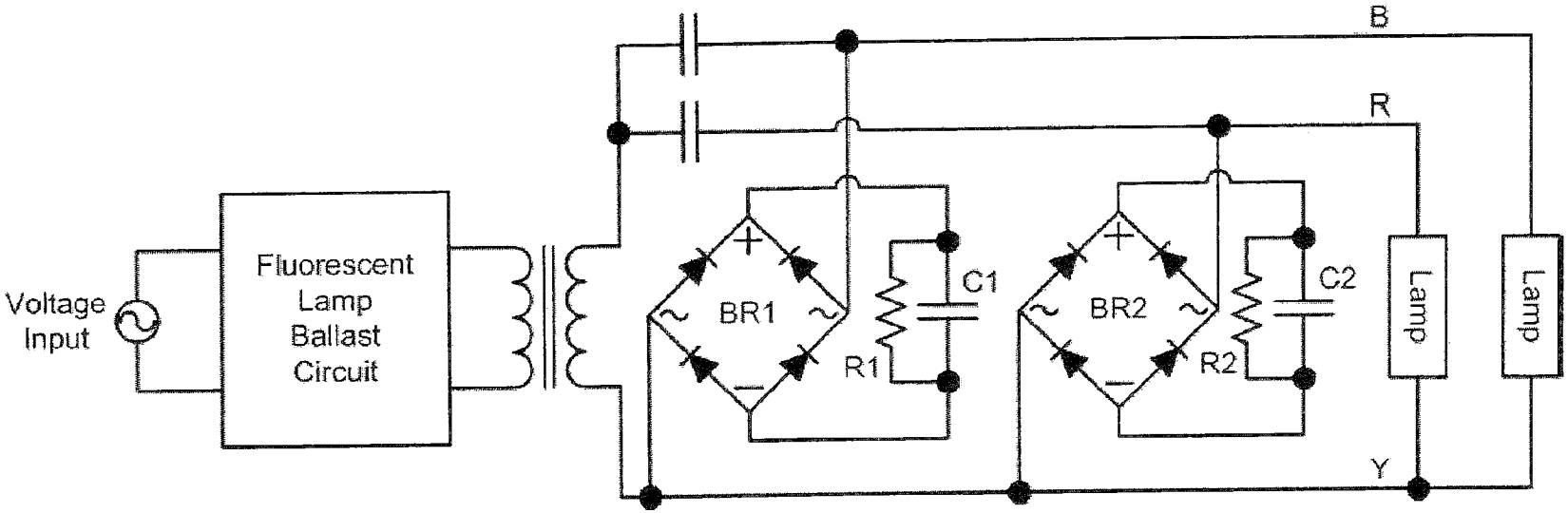
FIG. 5 is a schematic representation of a particular embodiment of the present invention using a passive anti-arcing component in an instant-start type electronic ballast driving two lamps.

FIG. 5 shows another embodiment according to the present invention, which is used in a two-lamp configuration. Here, two bridge-rectifier-resistor-capacitor networks (the circuit components according to the prevent invention) are needed, one for each of the lamps. With this configuration, arcing can be prevented when an individual lamp is suddenly disconnected for any reasons.

Figure 6:
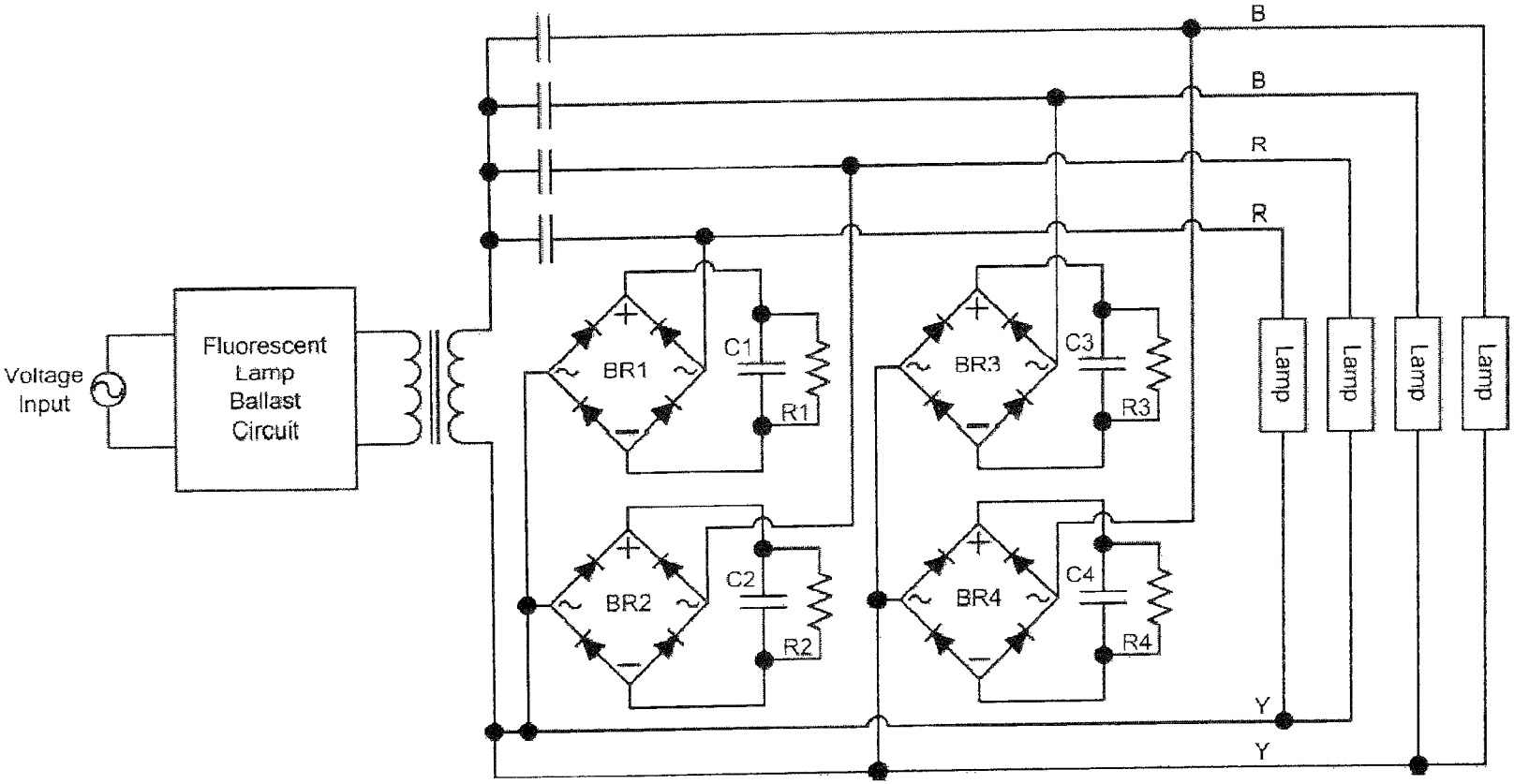
FIG. 6 is a schematic representation of a particular embodiment of the present invention using a passive anti-arcing component in an instant-start type electronic ballast driving four lamps.

Similarly, the present invention can be applied to a configuration used for driving four lamps as shown in FIG. 6. Here, each output wire is equipped with an individual bridge-rectifier-resistor-capacitor network of the prevent invention. When sudden disconnection of any lamp occurs, the spark energy will be redirected to the network corresponding to that lamp. As it would be clear to a person of ordinary skill in the art, the principle of the present invention can be easily applied to a ballast circuit that drives any practical number of the lamps.

Satisfactory results were obtained in an experiment set up to demonstrate the functioning behavior of the additional circuit. The experiment used the electronic ballast according to FIG. 5. The lamps used were 32 W T8 fluorescent tubes. The diode bridge rectifier is of a general purpose type for high voltage and low current situations. The capacitors are in hundreds of nanofarads, whereas the resistors are in hundreds of kiloohms. The choice of capacitance and resistance is a tradeoff between the steady-state power loss of the resistors and the anti-arcing effect. Larger capacitance and lower resistance values will result in higher loss, but will give better anti-arcing performance.

Figure 7:
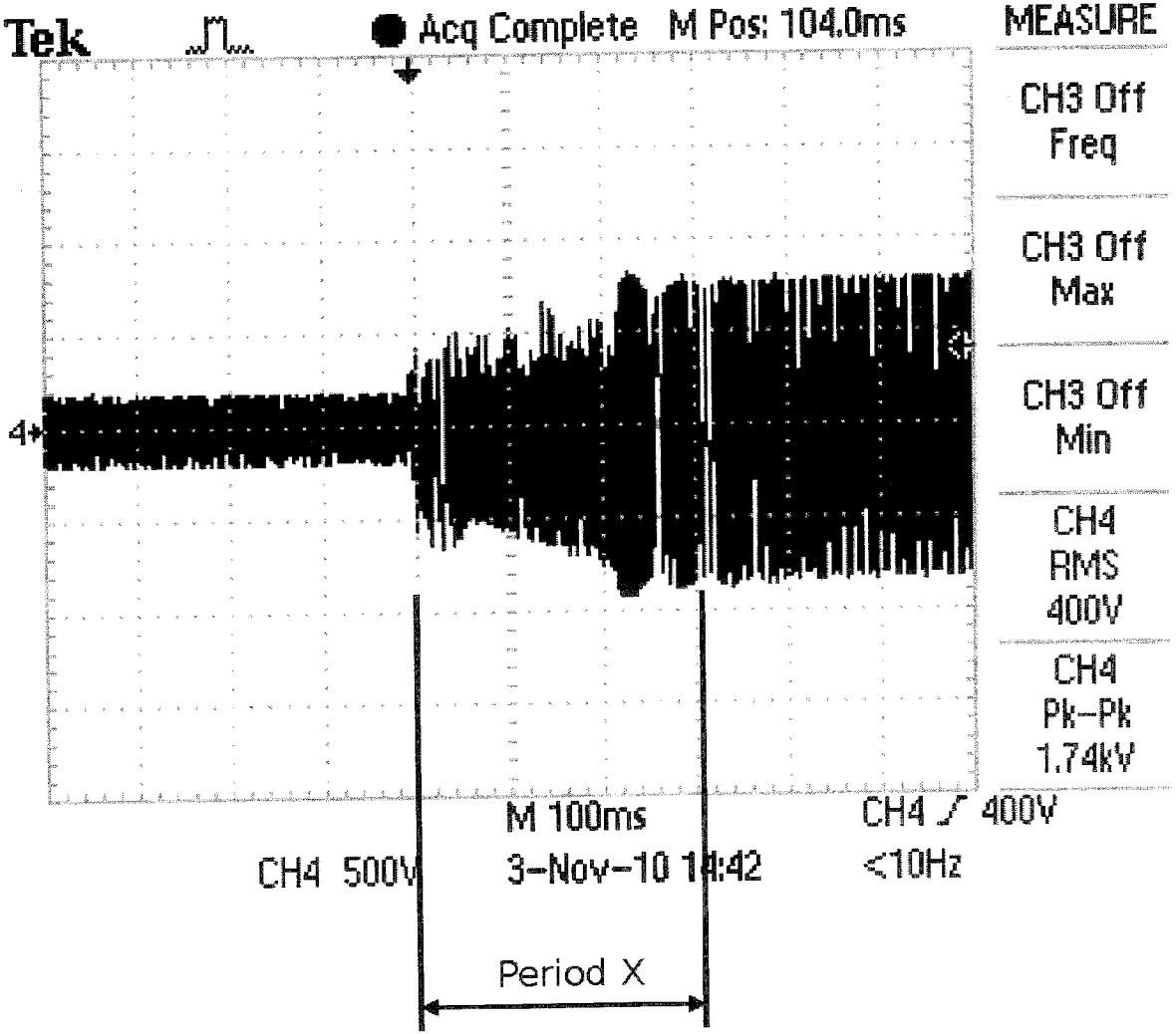
FIG. 7 shows the waveform across the output wires connecting to the lamp when the lamp is suddenly disconnected from the lampholders without using a passive anti-arcing component in an instant-start type electronic ballast according to the present invention.
Figure 8:
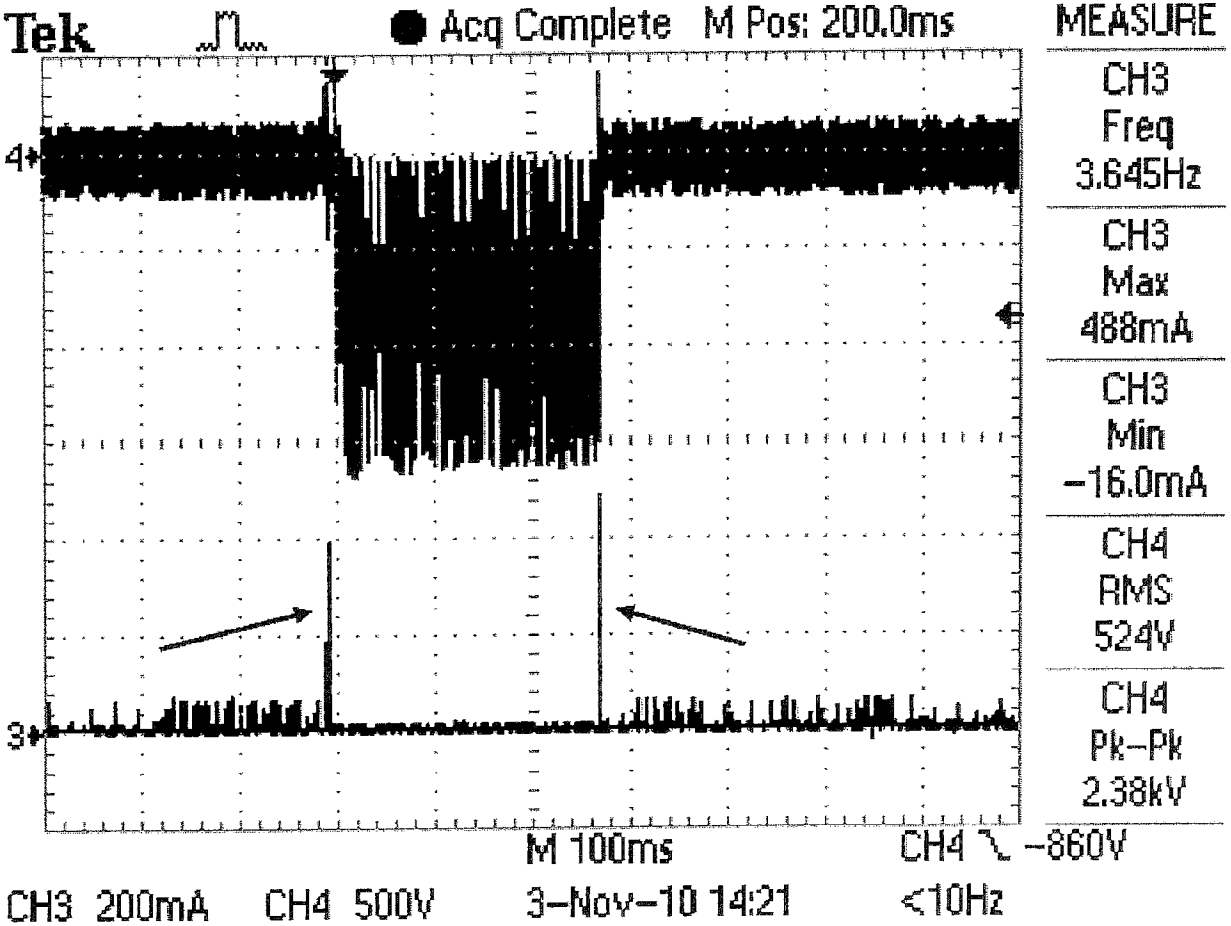
FIG. 8 shows the waveform across the output wires connecting to the lamp when the lamp is intermittently connected to the lampholders of the embodiment shown in FIG. 5.

The results of the experiment is shown in FIG. 7 and FIG. 8. FIG. 7 depicts a waveform before the addition of a bridge-rectifier-resistor-capacitor circuit component according to the present invention. CH4 shows the voltage across the output wires connecting to the lamp. When the lamp is suddenly removed from the lampholders, the aforementioned voltage grows to a very high value, causing the occurrence of arcing, as the highlighted time period X in the figure. When the lamp was moved to further away, the arc diminished and the aforementioned voltage became steadily high. If the lamp were to be reconnected to the lampholders at this moment, arcing would likely to occur again.

On the other hand, FIG. 8 depicts situations after adding the bridge-rectifier-resistor-capacitor circuit component according to the present invention. The waveform shows the current going through a diode in the bridge rectifier (CH3) and the voltage across the output wires connecting to the lamp (CH4). When the lamp was suddenly disconnected, current flowed through the diode into the resistor-capacitor network and, as a result, the arcing did not occur. When the lamp was reconnected to the lampholders, a current also flowed through the diode into the resistor-capacitor network. Again, it effectively eliminated the arcing.

While there have been described and pointed out fundamental novel features of the invention as applied to a preferred embodiment thereof, it will be understood that various omissions and substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims.

What is claimed is:

1. An electrical device, comprising:

(a) a load of at least one fluorescent lamp in a lampholder;

(b) an electronic ballast for supplying electricity to start and maintain normal operation of said fluorescent lamp; and (c) a passive anti-arcing component, said component forming a low-resistance electric path bypassing said load of fluorescent lamp to absorb any sudden changes in energy.

2. The electrical device of claim 1, wherein said passive anti-arcing component comprising at least a resistor, a capacitor and diode.

3. The electrical device of claim 1, wherein said passive anti-arcing component comprising a plurality of diodes.

4. The electrical device of claim 1, wherein said passive anti-arcing component is connected to output wires of said electronic ballast.

5. The electrical device of claim 3, wherein said passive anti-arcing component is connected to output wires of said electronic ballast internally.

6. The electrical device of claim 3, wherein said passive anti-arcing component is connected to output wires of said electronic ballast externally.

7. The electrical device of claim 3, wherein said passive anti-arcing component is located inside a casing of said ballast.

8. The electrical device of claim 3, wherein said passive anti-arcing component is located outside a casing of said ballast.

9. An electrical component, comprising (a) a network of at least a diode, a resistor and a capacitor, and (b) a connection element for connecting to an electronic ballast and forming a bypassing to a load of fluorescent lamp.

10. The electrical component of claim 9, wherein said network is located external to a casing of said electronic ballast.

11. The electrical component of claim 9, wherein said network is located internal to a casing of said electronic ballast.

12. The electrical device of claim 3, wherein said plurality of diodes form a bridge rectifier.

13. The electrical component of claim 9, wherein said network comprises a plurality of diodes.

14. The electrical component of claim 13, wherein said plurality of diodes form a bridge rectifier.

* * * * *